United States Patent [19]

Burke

[11] 4,054,166

[45] Oct. 18, 1977

[54] CHRISTMAS TREE COVER

[76] Inventor: John J. Burke, 5547 S. Sacramento, Chicago, Ill. 60629

[21] Appl. No.: 767,365

[22] Filed: Feb. 10, 1977

[51] Int. Cl.[2] ..... B65D 81/00

[52] U.S. Cl. ..... 150/52 R; 224/5 R

[58] Field of Search ..... 150/52 R; 47/21, 25, 47/28 R, 32; 224/5 R, 45 R

[56] References Cited

U.S. PATENT DOCUMENTS

| | | | |
|---|---|---|---|
| 1,446,563 | 2/1923 | Hughes | 150/52 R |
| 2,781,811 | 2/1957 | Dilar | 150/52 R |
| 2,868,255 | 1/1959 | Fancher | 150/52 R |
| 2,911,025 | 11/1959 | Paros | 150/52 R |
| 3,249,140 | 5/1966 | Jackson | 150/52 R |
| 3,750,731 | 8/1973 | Brimmell | 150/52 R |

*Primary Examiner*—Donald F. Norton
*Attorney, Agent, or Firm*—Allen D. Brufsky

[57] ABSTRACT

A cover for carrying a Christmas tree so that needles on the tree falling from the tree are retained in the cover. A flexible sheet is wrapped around the tree and has overlapped edges secured together by snap fasteners. Straps strung through belt loop adjacent the top and bottom edges of the sheet draw the cover tight. A drop cloth is removably secured to the bottom of the cover by a zipper to catch needles and may be draped around the base of the tree when in use. A pair of carrying handles are connected to the sheet or alternatively, an adjustable strap is looped over the ends of the tree and cover for toting the tree and cover.

8 Claims, 6 Drawing Figures

CHRISTMAS TREE COVER

BACKGROUND OF THE INVENTION

This invention relates to a covering for Christmas trees and more particuarly, to a combination Christimas tree covering and needle catcher.

When a Christmas tree is carried either in or out of a house, the branches thereof tend to shed needles and especially when the tree is bumped against door jambs and so forth. Accordingly, it is the primary object of this invention to provide a Christmas tree covering or bag which may be easily and quickly mounted on a Christmas tree when the tree is either taken in or out of the house whereby any needles falling from the tree will be caught in the covering.

SUMMARY OF THE INVENTION

In accordance with the invention, the covering includes a frusto-conical flexible plastic sheet adapted to be wrapped around the tree and secured to itself by conventional snaps. Belt loops are secured to the upper and lower edges of the sheet and receive straps which are drawn tight in buckles to secure the sheet to the tree. A drop cloth is secured by a zipper or the like to the bottom of the sheet to catch needles as the tree is carried into or out of a house. When the tree is displayed, the drop cloth may be detached from the cover and retained by a second zipper around the base of the tree. A pair of straps are secured to the sheet to carry the cover and the tree or an elongated longitudinal strap having looped ends can be disposed over the top of the tree and cover and the base of the tree and cover to tote the tree.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
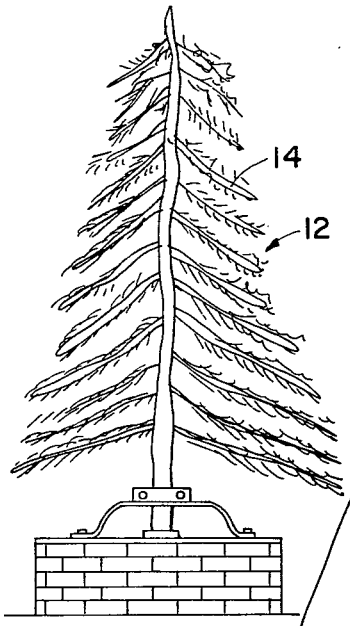
FIG. 1 is a front view in elevation of a Christmas tree carried by the cover of the present invention.

Referring now to the drawing in detail, wherein like numerals indicate elements throughout the several views, the cover 10 of the present invention is used to cover a live Christmas tree 12 to carry the tree to and from the house without dropping any of the needles 14 of the tree 12 on the floor.

The cover 10 includes a flexible sheet 16 which is generally frusto-conical in shape when opposite edges 18, 20 are overlapped and secured to each other by conventional snaps 22. Snaps 22 do not extend adjacent to the top and bottom edges of cover 10 because the needles 14 can fall through the loose openings between the overlapped edges 18, 20. Rather, sheet 16 is wrapped around the tree 12 and a strap 24 provided with a friction buckle 26 is received through belt loops

Figure 3:
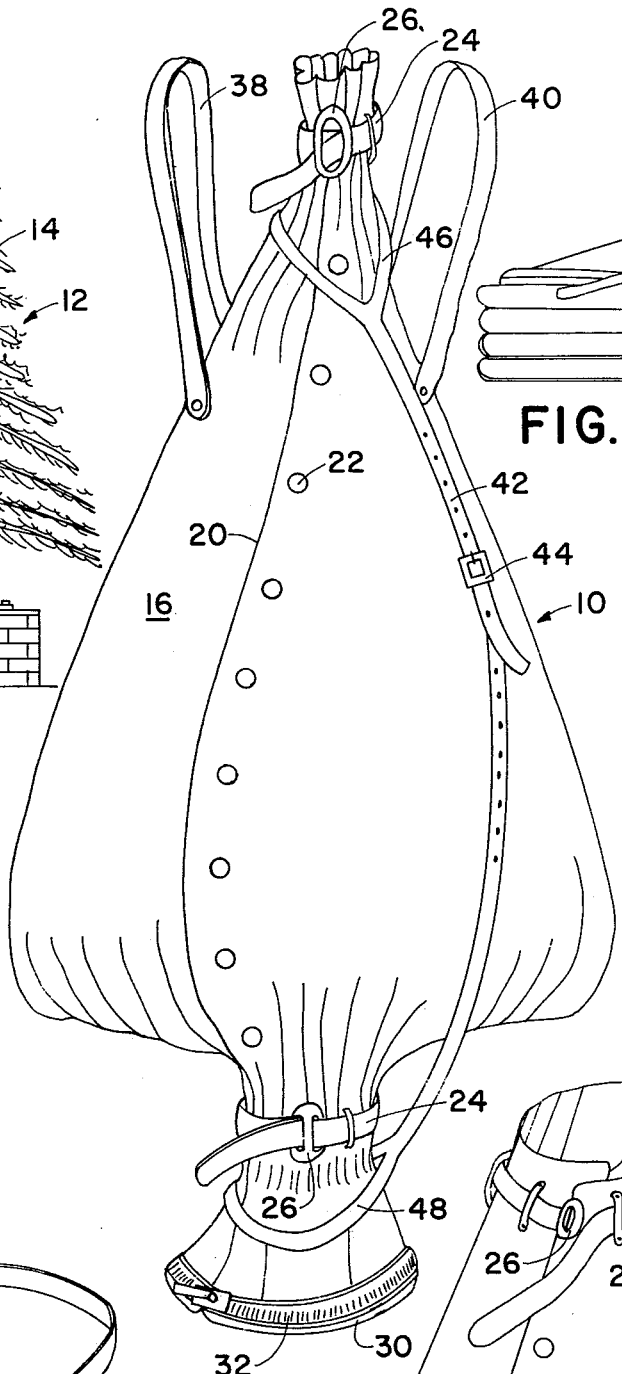
FIG. 3 is a perspective view of the cover of FIG. 2 wrapped about the tree of FIG. 1.

28 adjacent the top and bottom edges of sheet 16. The straps 24 are drawn tight in buckles 26 about sheet 16 to secure the cover 10 to the tree 12, as shown in FIG. 3.

Figure 4:
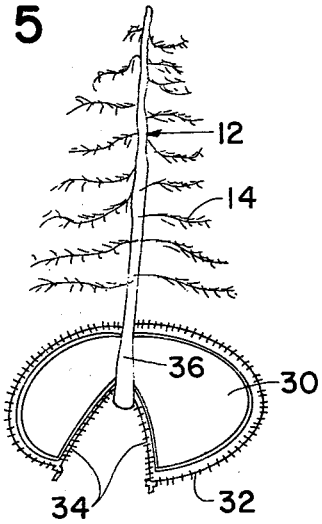
FIG. 4 is a perspective view of the bottom portion of the cover of FIGS. 2 and 3 used as a drop cloth.
Figure 6:
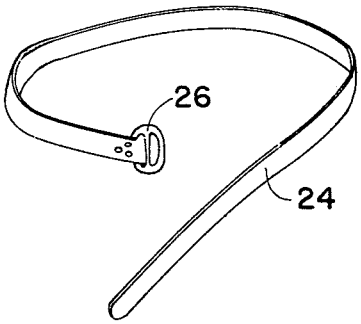
FIG. 6 is a perspective view of one of the straps used to tie the cover of FIGS. 2 and 3.
Figure 2:
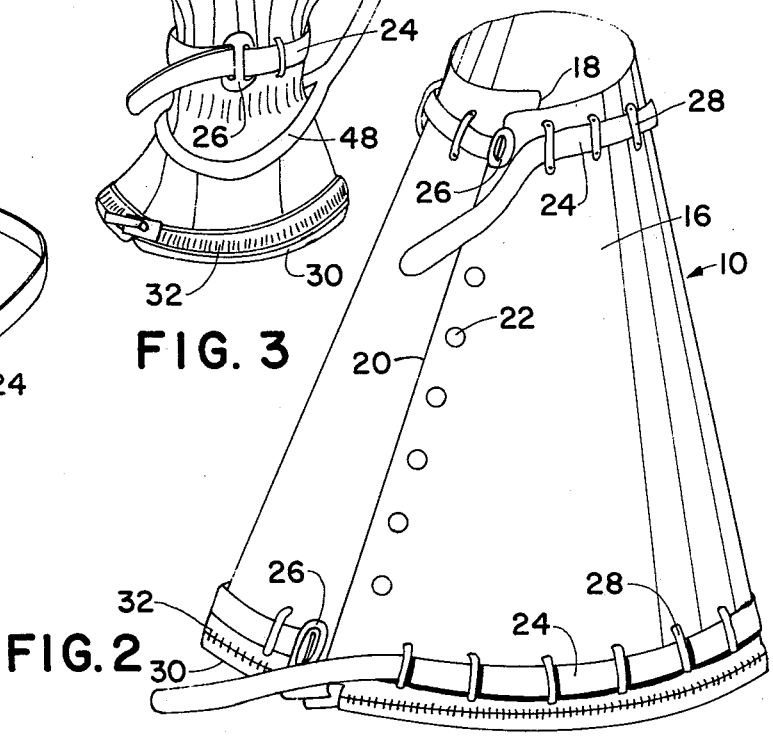
FIG. 2 is a perspective view of the cover of the present invention.

A drop cloth 30 is secured by a zipper 32 on the bottom of sheet 16 and drop cloth 30 to the sheet to close the bottom of cover 10 so the tree 12, and cover 10 may be freely carried without fear that needles 14 will drop from tree 12 onto a floor. When the tree 12 is displayed, as shown in FIG. 1 or FIG. 4, the zipper 32 may be opened and drop cloth 30 removed from cover sheet 16. Drop cloth 30 has a second radial zipper 34 secured to the edges of a radial slit which may be opened and the slit slid along the trunk 36 of tree 12 and the edges refastened by zipper 34 to retain drop cloth 30 about the base fo trunk 36 to catch needles 14 which may fall from the tree 12.

A pair of straps 38, 40 may be secured to sheet 16 to carry cover 10 and tree 12 into and out of a house. Alternatively, an elongated adjustable length strap 42 received in a buckle 44 may have loop ends 46, 48 disposed over the top and bottom of cover 10 and tree 12 to tote the tree and cover.

Figure 5:
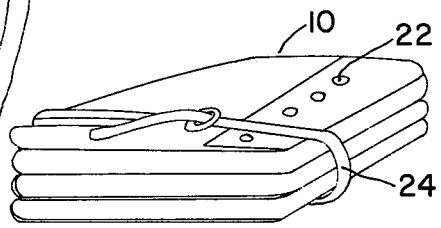
FIG. 5 is a perspective view of the cover of FIGS. 2 and 3 folded for storage.

After the tree 12 is disposed of, cover sheet 16 may be removed and folded for storage along with drop cloth 30, as shown in FIG. 5. One or more of the straps 24 may be used to retain the folded shape of cover 10.

While a specific embodiment of a Christmas tree cover has been disclosed in the foregoing description it will be understood that various modifications within the spirit of the invention may occur to those skilled in the art. Therefore, it is intended that no limitations be placed on the invention except as defined by the scope of the appended claims.

I claim:

1. A Christmas tree carrying cover comprising:

a flexible sheet of material adapted to be wrapped about a Christmas tree, with opposite edges overlapping;

complemental means on each of said edges for retaining said edges secured together;

a drop cloth removably secured to the bottom edge of said sheet; and tie means adjacent the top and bottom edges of said sheet for drawing said sheet taut about said tree;

said drop cloth including a radial slit enabling said drop cloth to be draped about the trunk of a tree when removed from said sheet.

2. The cover of claim 1 including means adapted to be connected to said sheet for carrying said sheet and a tree within said cover.

3. The cover of claim 1 wherein said tie means includes:

a plurality of vertical belt loops adjacent the top and bottom edges of said sheet; and a strap received through said belt loops.

4. The cover of claim 1, wherein said complemental means includes a plurality of snap fasteners.

5. The cover of claim 1, wherein said drop cloth is removably secured to the bottom edge of said cover by a zipper.

6. The cover of claim 1, wherein said drop cloth includes a zipper adjacent the edges of said radial slit for securing said drop cloth about a tree trunk.

7. The cover of claim 2, wherein said carrying means includes a pair of straps secured to said flexible sheet.

8. The cover of claim 2, wherein said carrying means includes an adjustable strap having looped ends draped over the top and bottom of said cover and tree.

* * * * *